United States Patent [19]

Lanier et al.

[11] Patent Number: 4,677,776

[45] Date of Patent: Jul. 7, 1987

[54] DEVICE FOR MARKING PRESENCE, RESERVATION OR INFORMATION

[76] Inventors: Jean-Pierre R. Lanier, Hameau de Margerie, 26230 - Colonzelle; Georges P. Marie, Chemin du Moulin, Richerenches - 84600 - Valreas, both of France

[21] Appl. No.: 753,274

[22] Filed: Jul. 9, 1985

[30] Foreign Application Priority Data

Jul. 13, 1984 [FR] France ..... 84 11268

[51] Int. Cl.[4] ..... G09F 3/18

[52] U.S. Cl. ..... 40/15 R

[58] Field of Search ..... 194/205, 247; 40/27.5, 40/15 R; 70/DIG. 41, DIG. 14, DIG. 17, DIG. 59, 432, 57, 59, 62; 221/27, 28, 29

[56] References Cited

U.S. PATENT DOCUMENTS 362,882 5/1887 Drinker ..... 40/15 R
799,565 9/1905 Hilbig ..... 70/62
960,131 5/1910 Wilson et al. ..... 194/205

FOREIGN PATENT DOCUMENTS

A-281399 12/1927 United Kingdom .

*Primary Examiner*—Robert Peshock
*Assistant Examiner*—Cary E. Stone
*Attorney, Agent, or Firm*—Balogh, Osann, Kramer, Dvorak, Genova & Traub

[57] ABSTRACT

A device for marking presence, reservation or information by at least one lockable badge engaged in a case. The case houses a plurality of juxtaposed flexible blades and fixed blades presented opposite a front wall of the case, the flexible blades being mounted in elastic manner in the case and cooperate with the badge to lock it on the case. The badge has cavities on one of its faces, which cavities are juxtaposed and correspond to blades, certain of these cavities cooperating with free ends of the flexible blades. At least one other flexible blade substantially parallel to the flexible blades is mounted in elastic manner in the case and has at least one configuration on at least one of its side edges. A key is engaged frontally in the case and cooperates with the flexible blades, the key having on its front edge a plurality of notches determining projections to abut on the flexible blades, the key having at least one lateral notch adapted to latch on said configured flexible blade which is notched or which has a projection, to lock the key on the configured flexible blade in the absence of a badge on the case.

14 Claims, 10 Drawing Figures

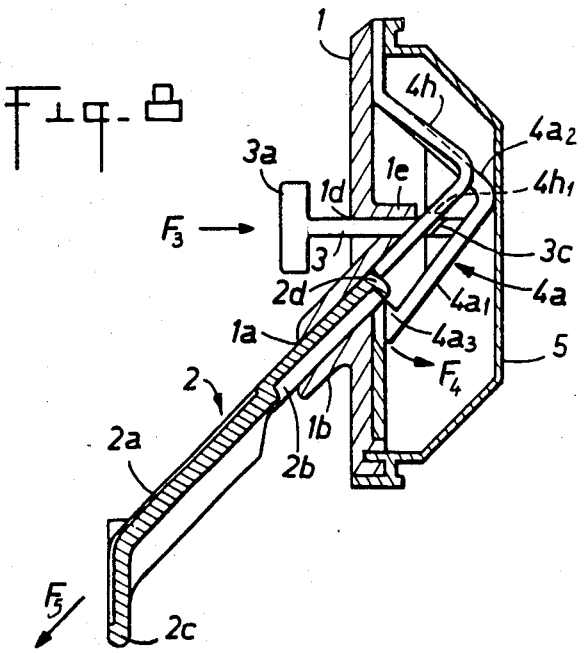
1
4h
4a2
3a
1e
4h1
1d
F3
3c
3
2d
4a1
4a
1a
4a3
5
F4
2
1b
2a
2b
F5
2c

DEVICE FOR MARKING PRESENCE, RESERVATION OR INFORMATION

The present invention relates to a device for marking presence, reservation or information by means of at least one lockable badge or the like engaged in a board or a case.

The technical sector of the invention is that of planning or like devices.

The object to be attained is an apparatus for marking presence, reservation or information, making it possible to see instantaneously on the board or case indications borne on locked keys and for introducing badges opposite said keys, so that the introduction of said badges allows the keys to be withdrawn and the presence of badges on the board or case thus gives information or indicates occupancy or presence. The invention is particularly applicable for reservations in various sporting activities such as tennis, sailing or the like, or for indicating presence in a work place or the like.

This object is attained by the device according to the invention, which is characterized in that it comprises, in combination:

a plurality of juxtaposed flexible blades and fixed blades presented opposite the front wall of the board or case, of which the flexible blades are mounted in elastic manner in the board or case and cooperate with the badge to lock it on said board or case;

a badge comprising cavities on one of its faces, which cavities are juxtaposed and correspond to said blades, certain of these cavities cooperating with the free end of said flexible blades;

at least one other flexible blade substantially parallel to said blades and mounted in elastic manner in the board or case and comprising at least one notch or one projection on at least one of its side edges;

a key engaged frontally in the board or case and cooperating with said flexible blades, which key comprises on its front edge a plurality of notches determining projections to abut on the flexible blades and further comprises at least one lateral notch adapted to latch on said flexible blade which is notched or which comprises said projection, to lock the key on said blade in the absence of a badge on the board or case, so that the badge, in locked position, exerts a pressure on said blade which is notched or comprises the projection, to displace the notch or projection and to allow the withdrawal of the key and so that the complete engagement of the key in the board or case, by displacement of the flexible blades, causes the ends of the blades to leave said cavities of the badge, to allow said badge to be withdrawn.

The invention will be more readily understood on reading the following description with reference to the accompanying drawings, in which:

FIGS. 6 to 8 show the case in transverse section along line VI–VII–VIII of FIG. 1. In this embodiment, the badges are engaged in frontal manner and inclined with respect to the facade wall of the case.

Figure 1:
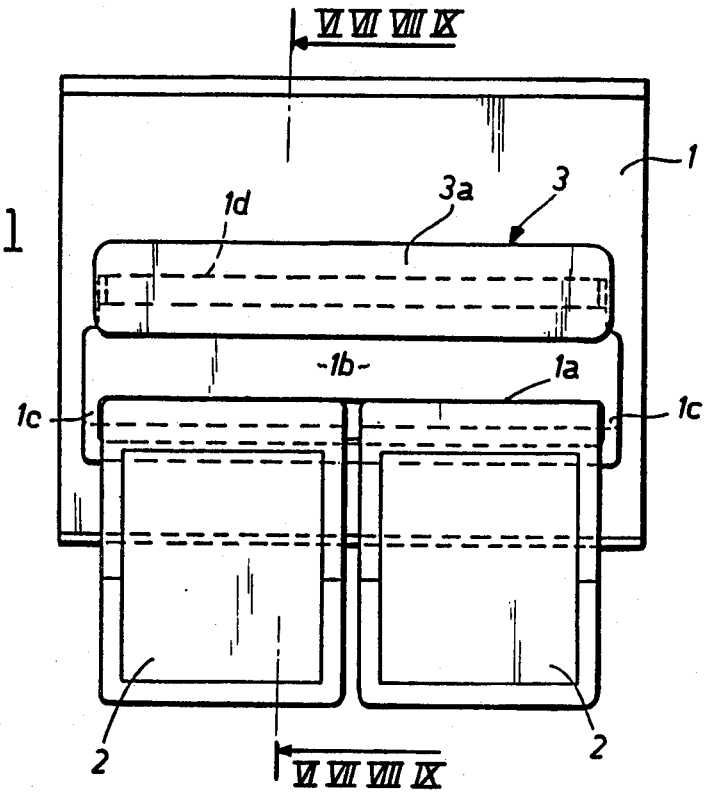
FIG. 1 is a front view of a device according to the invention in an embodiment in the form of a case adapted to receive two badges.

Referring now to the drawings, the device according to the invention, in one embodiment, is in the form of a case or board and comprises (FIGS. 1 and 2), a rectangular facade wall 1, which comprises an inlet 1*a* parallel to the longitudinal edges of the facade to allow passage of the badges 2, which inlet 1*a* is oblique, for example at 45° (FIGS. 6 to 8), so that the badges 2 are engaged in the case upwardly. Walls 1*b* which are parallel to one another and oblique ensure guiding of the badge 2 and end walls 1*c* parallel to the lateral edges of the case limit the inlet 1*a* laterally.

Above the inlet 1*a* there is reserved a slot 1*d* which extends over the length of the inlet 1*a* and is adapted to receive a key 3. This key 3 takes the form of a rectangular plate of which one of its longitudinal edges comprises a wall 3*a* perpendicular to said plate and extending on either side thereof, so that the key 3 has a cross section in the form of a T.

Figure 2:
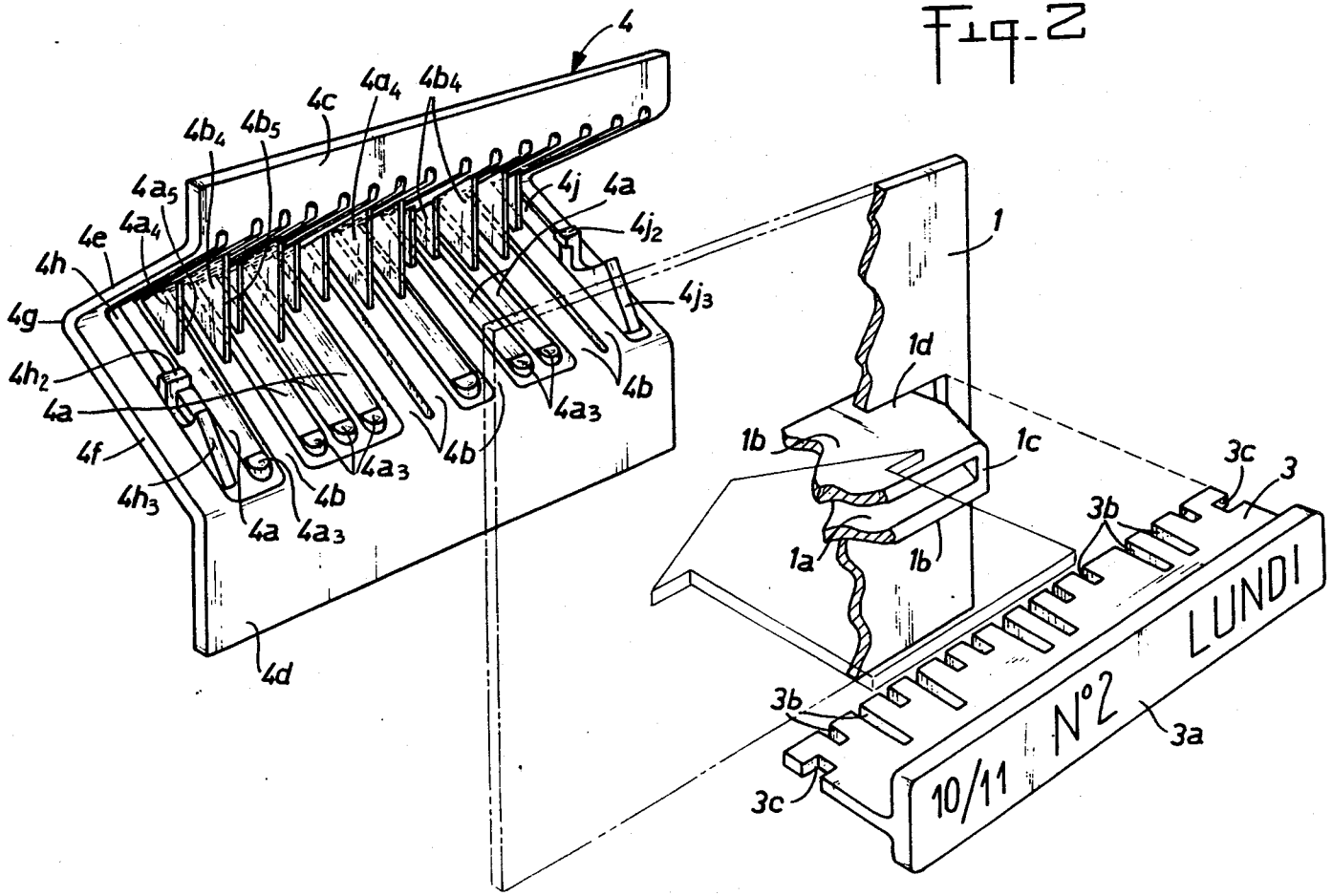
FIG. 2 is an exploded view in perspective of the case of FIG. 1 where the badges have not been shown.
Figure 4:
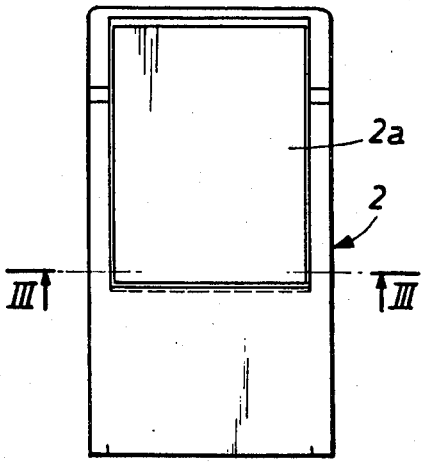
FIG. 4 is a plan view of a badge.
Figure 3:
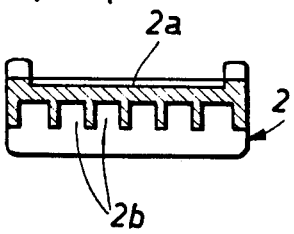
FIG. 3 is a view in transverse section of a badge at the level of the locking cavities along line III–III of FIG. 4.

Wall 3*a* extends for example over the whole length of the key. Slot 1*d* (FIGS. 6 to 8) extends inside the case by a guide wall 1*e* perpendicular to the facade wall 1*a* so that the key is engaged in the case in frontal manner and perpendicularly to the facade 1. The wall 3*a* has, on the one hand, a function of gripping member to ensure manipulation of the key and, on the other hand, another function of support of information, as shown in FIG. 2.

Behind the front wall 1 of the case and contiguous thereto, is fixed an elbowed plate 4, which takes the form of a sort of comb and comprises flexible blades 4*a* and fixed blades 4*b* which blades are thus disposed opposite wall 1. Said blades 4*a*/4*b* are reserved in the central part of the plate 4 and are distributed over the length of the inlet 1*a* and the slot 1*d*, which are of the same length.

The plate 4 comprises two parts 4*c*/4*d* extending in the same plane and which are applied against the front wall 1 when the case is mounted; part 4*c* is located above the blades 4*a*/4*b*, part 4*d* is located therebelow.

The two parts 4*c*/4*d* are connected to each other by two other parts 4*e*/4*f* which converge on a line 4*g* to form an angular profile. Blades 4*a*/4*b* are reserved in that part of the plate comprising parts 4*a*/4*f* so that all the fixed and mobile blades are elbowed and comprise two parts $4a_1/4b_1$-$4a_2/4b_2$ which diverge towards wall 1.

Flexible blades 4*a* are mounted in elastic manner on part 4*c* and their free end is therefore located towards part 4*d* of the plate. All the blades are thus juxtaposed and are parallel to one another.

In an embodiment illustrated in FIGS. 2 and 6 to 8, the flexible blades 4*a* comprise at their free end a catch $4a_3$ fast with part $4a_1$ and adapted to cooperate with the cavities of the badge. Parts $4a_1/4b_1$–$4a_2/4b_2$ of the blades are connected on one another by a web $4a_4/4b_4$ of which the outer edge $4a_5/4b_5$ is substantially parallel to the front wall 1 of the case. The distances which connect the elbowed part of the blades and the edge $4a_5$ are different from one blade to the other, which webs correspond and cooperate with notches 3*b* reserved in the key 3 and on its longitudinal edge opposite the one which comprises the wall 3*a*. In this way, by introducing the key in slot 1*d*, a pressure may be exerted on the flexible blades 4*a* but on condition that the profile of the key is appropriate and does not come into abutment on webs $4b_4$ of blades 4*b*.

In addition to this assembly of flexible blades 4*a* and fixed blades 4*b*, the device comprises, in an embodiment illustrated in the drawings, two additional flexible blades 4*h*/4*j*, which blades are located at the ends of the assembly of said blades 4*a*/4*b* and their function is to ensure locking of key 3. Blades 4*h*/4*j* are elbowed and substantially parallel to blades 4*a*/4*b* and are mounted in elastic manner in part 4*c* of plate 4.

Figure 5:
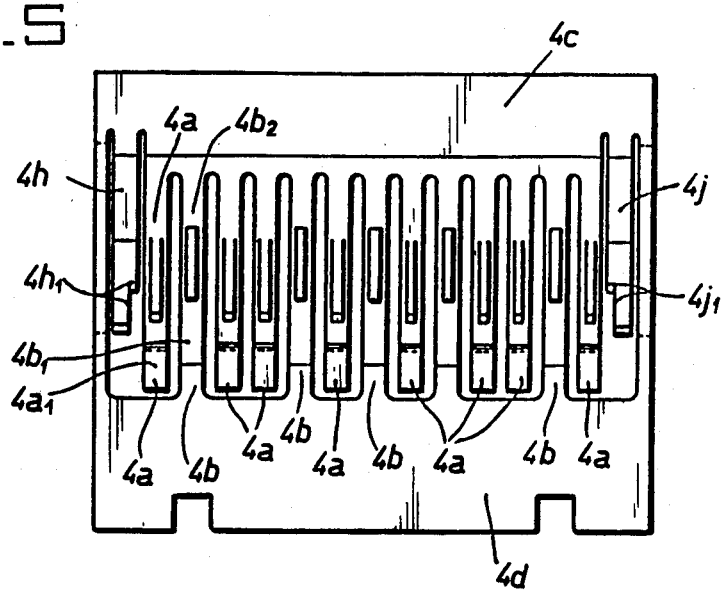
FIG. 5 is a front view of the assembly of the fixed and flexible blades.

In an embodiment illustrated in FIG. 5, they comprise, at their free end, a notch $4h_1/4j_1$ located towards the assembly of blades 4*a*/4*b*, which notches have for their function to allow the key 3 to be withdrawn from the case as will be set forth hereinbelow.

In another embodiment illustrated in FIG. 2, blades 4*h*/4*j* comprise a projection $4h_2/4j_2$ emerging on the side of part 4*e* of plate 4, this projection being adapted to cooperate with notches 3*c* reserved on the side edges of key 3 at the rate of one notch per edge to lock the key in the case. The notches $4h_1/4j_1$, shown in FIG. 5, and the projections $4h_2/4j_2$, shown in FIG. 2, can be generally called configurations, and the blades having such configurations can be called configured flexible blades.

In this embodiment, the free end $4h_3/4j_3$ of blades 4*h*/4*j* is sloping in order to provoke bending of blades 4*h*/4*j* when the badges 2 are introduced into the case and correlatively cause the projections $4h_2/4j_2$ to emerge from the notches 3*c* of the key, the badges 2 then being in contact with the sloping ends of said blades.

The badges 2 are generally rectangular in shape and comprise on one of their faces a location 2*a* for fixing a photograph or inscriptions, for example, and on their opposite face a plurality of cavities 2*b* for taking for example the form of grooves parallel to one another and to the longitudinal edges of the badges.

Figure 6:
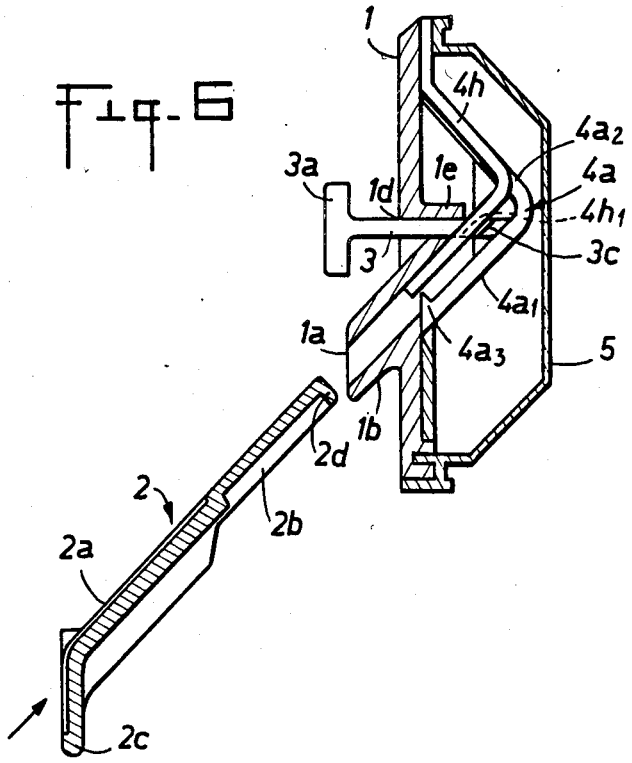
Figure 7:
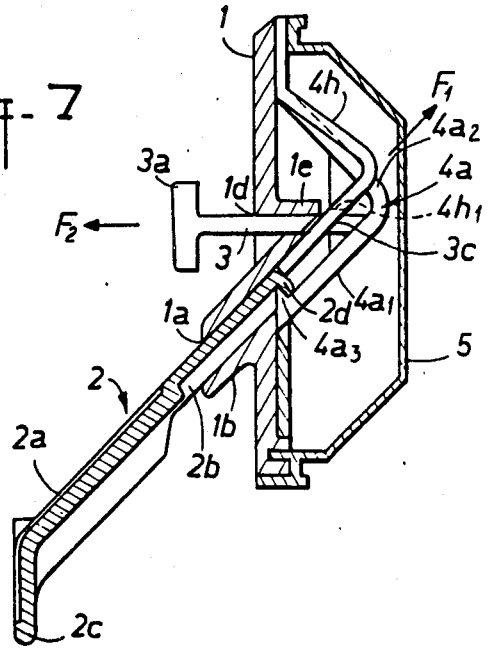

In the embodiment illustrated in FIGS. 6 to 8, the key is engaged obliquely in the inlet 1*a* and comprises a part 2*c*, which, when the key is fixed to the case, is parallel to the wall 1 of said case.

The badge further comprises, at its end opposite the one which comprises part 2*c*, a short wall 2*d* which closes the grooves 2*b*.

Reference will now be made to FIGS. 6 to 8 which schematically illustrate the operation of the device of which the flexible blades 4*a* are those illustrated in FIG. 2 and those 4*h*/4*j* are the ones of FIG. 5.

In FIG. 6, the key 3 is locked in the case, the key being latched onto blades 4*h*/4*j*. The notches 3*c* of the key are in abutment on that part of the blades adjacent said notches $4h_1/4j_1$ of the blades and located towards the elbowed part of the blades.

In this position, the key is prisoner in the case and cannot be withdrawn. The badge 2 is in position of introduction in the inlet 1*a* of the case.

In FIG. 7, the badge has been introduced into inlet 1*a* and is locked in the case, the catches $4a_3$ of blades 4*a* being inside the grooves 2*b* of the badge.

During its introduction and before it is locked, the badge comes into abutment on the free end of the blade 4*h* and pushes the latter in the direction of arrow $F_1$. As soon as locking is produced and as illustrated in FIG. 7, the notch $4h_1$ of the blade is thus located on the side of key 3. The notch 3*c* escaping contact with the blade, the key 3 may be withdrawin in the direction of arrow $F_2$, passing in the space reserved by said notch $4h_1$ of the blade. The badge 2 remains locked in the board.

In order to unlock badge 2 (FIG. 8) from the case, the key 3 is introduced into slot 1*d* and in the direction of arrow $F_3$, the notch $4h_1$ being retracted, the key does not latch onto the blade 4*h* and comes into abutment on the flexible blade 4*a*. A pressure is then exerted on key 3, still in the direction of arrow $F_3$, to exert a pressure on part $4a_1$ of the flexible blades and to cause the catches $4a_3$ to retract in the direction of arrow $F_4$ and leave grooves 2*b*.

The badge may then be withdrawn from the case in the direction of arrow $F_5$. By releasing the pressure on the key, part 4*a* of the flexible blades returns into its initial position. The blade 4*h* also returns into its intial position of FIG. 6 and the key 3 is again locked.

Figure 9:
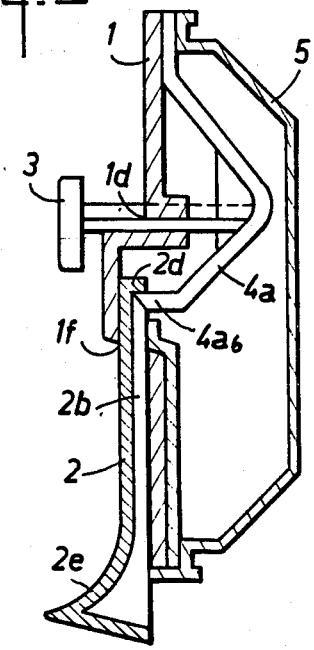
FIG. 9 is a view in section of the case along line IX—IX of FIG. 1. In this embodiment, the badge is engaged parallel to the facade wall of the case.
Figure 10:
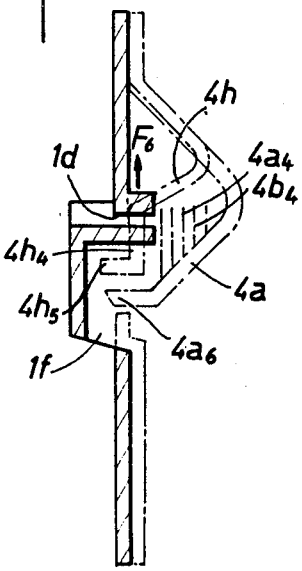
FIG. 10 is a view in section of the device according to the invention along line IX—IX of FIG. 1 illustrating more particularly the locking blades of the key and badges.

FIGS. 9 and 10 show another embodiment of a device according to the invention.

The design and operation of key 3 are identical to those described previously with reference to FIGS. 1 to 8.

According to FIGS. 9 and 10, the badge 2 is engaged parallel and against the wall 1 of the case and is guided in an inlet 1*f* defined by two walls parallel to the wall 1 of said case. The free end $4a_6$ of the flexible blades 4*a* does not comprise a catch and is presented perpendicularly to wall 1 to penetrate in the grooves 2*b* of the badge. Operation is the same as that described with reference to FIGS. 6 to 8.

The badge 2 comprises for example a "return" 2*e* at its end opposite the one comprising the wall 2*d*, which return extends on the side opposite the wall 1 of the case.

The blades 4*h*/4*j* for locking the key 3 are very similar to those equipping the device described hereinbefore. As illustrated in FIG. 10 and according to an embodiment of the invention, they comprise an extension $4h_4$, which is disposed near the inner face of the facade wall 1 and comprises a heel $4h_5$ extending perpendicularly to the extension $4h_4$ and towards the inlet 1*f* in order to obstruct the badge 2 during its introduction in the case. The extension comprises a notch (or a projection) whose function is identical to that described with reference to FIGS. 1 to 8. When badge 2 is locked at the end $4a_6$ of the flexible blades 4*a*, said notch (or projection) is displaced in the direction of arrow $F_6$ under the effect of the badge, thus allowing the key 3 to be withdrawn.

The case is closed, for example, by a rear element 5.

Of course, without departing from the scope of the invention, those parts which have just been described may be replaced by the man skilled in the art by equivalent parts performing the same function. The invention has been described in an application to a case; it is not limited to this application but may take the form of a board comprising a plurality of juxtaposed and superposed badges and keys.

In the drawings (FIGS. 2 and 5), the flexible blades 4*h*/4*j*, which ensure locking of the key 3, are located at the ends of the assembly of blades 4*a*/4*b*. It is specified that said blades 4*h*/4*j* may be provided at any other point of the whole, the key 3 being adapted accordingly.

What is claimed is:

1. A device for marking presence, reservation or information by means of at least one badge engaged in a case, comprising:

a plurality of juxtaposed flexible blades and fixed blades presented opposite a front wall of the case, of which the flexible blades are mounted in elastic manner in the case and cooperate with the badge to lock it on said case;

a badge comprising cavities on one of its faces, which cavities are juxtaposed and correspond to said blades, certain of these cavities cooperating with free ends of said flexible blades;

at least one other flexible blade substantially parallel to said blades and mounted in elastic manner in the case and comprising at least one configuration on at least one of its side edges; and a key engaged frontally in the case and cooperating with said flexible blades, which key comprises on its front edge a plurality of notches determining projections to abut on the flexible blades and further comprises at least one lateral notch adapted to latch on said configured flexible blade to lock the key on said blade in the absence of a badge on the case, so that the badge, in locked position, exerts a pressure on said configured blade to displace the configuration and to allow the withdrawal of the key and so that the complete engagement of the key in the case, by displacement of the flexible blades, causes the ends of the blades to leave said cavities of the badge, to allow said badge to be withdrawn.

2. The device of claim 1, wherein said blades are elbowed and comprise two parts which diverge towards the front wall of the case and said flexible blades are mounted in articulated manner on the case by their upper end.

3. The device of claim 2, wherein said flexible blades comprise, at their free end, catches for latching on the badge, adapted to penetrate in the cavities thereof.

4. The device of claim 3, wherein the divergent parts of the fixed blades and the flexible blades for locking the badge are connected to one another by webs of which the outer edge is substantially parallel to the front wall of the case.

5. The device of claim 4, wherein the webs are all of different height and correspond to the notches of the key.

6. The device of claim 5, comprising two blades for locking the key, which blades are disposed on either side of the assembly of fixed blades and flexible blades for locking the badge, each of said two blades having an inner lateral edge located towards said assembly of blades, each said inner lateral edge being provided with a notch.

7. The device of claim 5, comprising two locking blades for locking the key, which blades are disposed on either side of the assembly of fixed blades and flexible blades for locking the badge, and the blades for locking the key each comprise a projection borne by the free end of said blades and which extends towards that part of the latter which is connected to the case.

8. The device of claim 7, wherein the free end of said locking blades for locking the key comprises a sloping part on which abuts the badge in locked position, so as to free said projections from the notches of the key and allow the latter to be withdrawn from the case.

9. The device of claim 8, wherein the badge is engaged in the case in frontal manner and is in the plane of those parts of the flexible blades which comprise the catches.

10. The device of claim 10, wherein each locking blade is engaged parallel to the facade wall of the case and the flexible blades for locking the key comprise, at their free end, a heel on which the badge comes into abutment to unlock the key.

11. The device of claim 10, wherein the badge is generally rectangular in form and the cavities take the form of parallel grooves.

12. The device of claim 7, wherein the key comprises, on each of its lateral edges, a notch for cooperating in locking position with that part of each of said flexible blades adjacent the configured flexible blade.

13. The device of claim 1, wherein the key comprises, on each of its lateral edges, a notch for cooperating in locking position with that part of each of said flexible blades adjacent the configured flexible blade.

14. The device of claim 13, wherein the key is generally rectangular in form and said notches extend perpendicularly to one of its longest sides.

* * * * *